US006926272B2

(12) United States Patent
Carter et al.

(10) Patent No.: US 6,926,272 B2
(45) Date of Patent: Aug. 9, 2005

(54) SENSOR AND DIVERTER MECHANISM FOR AN IMAGE FORMING APPARATUS

(75) Inventors: Daniel L. Carter, Georgetown, KY (US); Edward Lawrence Kiely, Lexington, KY (US); John William Kietzman, Lexington, KY (US); Edward A. Rush, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 65 days.

(21) Appl. No.: 10/639,358

(22) Filed: Aug. 12, 2003

(65) Prior Publication Data

US 2005/0035540 A1 Feb. 17, 2005

(51) Int. Cl.[7] ..... B65H 7/02

(52) U.S. Cl. ..... 271/258.01; 271/265.01; 271/301; 271/303

(58) Field of Search ..... 271/301, 65, 186, 271/258.01, 265.01; 347/104, 153; 399/401

(56) References Cited

U.S. PATENT DOCUMENTS

| | | | | |
|---|---|---|---|---|
| 4,228,996 A | | 10/1980 | Wilcox, Jr. | |
| 4,300,758 A | | 11/1981 | Peter, III | |
| 4,699,365 A | | 10/1987 | Smith et al. | |
| 4,793,605 A | | 12/1988 | Tajima | |
| 4,901,117 A | | 2/1990 | Derrick | |
| 4,979,727 A | | 12/1990 | Koike et al. | |
| 4,986,529 A | | 1/1991 | Agarwal et al. | |
| 4,998,716 A | | 3/1991 | Okumura et al. | |
| 5,042,790 A | | 8/1991 | Miller et al. | |
| 5,093,690 A | | 3/1992 | Ohno et al. | |
| 5,153,663 A | | 10/1992 | Bober et al. | |
| 5,201,518 A | | 4/1993 | Isoda | |
| 5,234,213 A | | 8/1993 | Chen | |
| 5,263,708 A | | 11/1993 | Hacknauer | |
| 5,539,510 A | | 7/1996 | Yamashiro et al. | |
| 5,590,872 A | | 1/1997 | Oominami et al. | |
| 5,615,876 A | * | 4/1997 | Yergenson et al. | 271/258.01 |
| 5,882,130 A | | 3/1999 | Kumazaki et al. | |
| 5,964,460 A | | 10/1999 | Azumi et al. | |
| 5,974,298 A | | 10/1999 | Urban et al. | |
| 6,032,949 A | | 3/2000 | Ando | |
| 6,032,950 A | * | 3/2000 | Ikeda | 271/258.01 |
| 6,152,443 A | | 11/2000 | Claramunt et al. | |
| 6,247,695 B1 | * | 6/2001 | Linder et al. | 271/265.04 |
| 6,290,410 B1 | | 9/2001 | Sunada et al. | |
| 6,621,997 B2 | * | 9/2003 | Chung | 399/122 |
| 2004/0135311 A1 | * | 7/2004 | Chambers et al. | 271/265.01 |

* cited by examiner

*Primary Examiner*—David H. Bollinger
(74) *Attorney, Agent, or Firm*—Coats & Bennett, PLLC

(57) ABSTRACT

An arm that directs media sheets along multiple paper paths of an image forming device. The arm is mounted to pivot when contacted by the media sheet to direct the sheets along the proper media paths, and divert the sheets from entering the improper media paths. A sensor positioned adjacent to the arm senses movement of the arm to determine the location and timing of the media sheets as they move along the paper paths. Sensor is operatively connected to a controller which tracks the movement of the media sheets through the image forming apparatus. The arm may further be positioned to determine the orientation of an internal part. The arm moves between first and second orientations depending upon the position of the internal part. The position of the arm is again determined by the sensor. The invention further includes methods of moving the position of the arm to determine the location of the media sheets and/or the orientation of the internal part.

24 Claims, 11 Drawing Sheets

SENSOR AND DIVERTER MECHANISM FOR AN IMAGE FORMING APPARATUS

BACKGROUND

Image forming devices place an image on a media sheet thus producing an imaged output. The image forming devices include a paper path for moving the media sheet and receiving the image. The paper path may include a first path for forming an image on a first side of the media sheet, and a second path for forming an image on a second side of the media sheet.

The image forming device also include doors which open and close to allow access to the paper path. The doors allow for paper jams to be accessed and removed without disassembling the image forming device.

Previous image forming devices have used multiple devices for sensing and directing the media sheets. In one prior device, a first sensor was used to sense a media sheet moving into a first predetermined area of the paper path. A second sensor indicated the media sheet entering into a second predetermined area of the paper path. Further, a diverter was positioned to direct sheets between the first path and second path depending upon whether imaging occurred on both sides of the media sheet. Additionally, another sensor indicated whether the access door was in an open or closed orientation. Thus, four separate sensing and directing devices were used within the image forming device.

Price is often a driving factor weighed by consumers when purchasing an image forming device. Often times, price is the primary requirement in the purchasing decision, with other machine parameters being of secondary importance. Therefore, design implementations with several different operations performed by a single element are advantageous. The multi-functional element is a less-expensive alternative. As always, quality of the formed images should not be degraded by the multi-functional element.

SUMMARY

The present invention is directed to an arm positioned along the media path to direct the media moving along the path. The arm is positioned along the media path such that arm members extend outward into the media path. A sensor is positioned relative to the arm to sense the movement of the arm. Signals from the sensor are forwarded to a controller that interprets the signals to determine the location of the media sheet.

The arm may further be positioned to determine the orientation of an access door. Image forming devices include an access door to access the paper path to remove media jams. The arm may be positioned such that the arm pivots to a predetermined position when the door is opened. The sensor detects the movement of the arm and signals the controller indicating the door is in the open orientation.

In one embodiment, the arm is positioned with a first member extending across the first media path. The arm pivots to a second position as the media sheet moves past the arm along the first media path. The arm then pivots back to the first position when the media sheet moves beyond the arm. The arm pivots to another position as a media sheet moves along the second media path. Again, the arm returns to the first position when the media sheet moves along the second media path beyond the arm. The arm also pivots when the access door is opened. The sensor detects the movement of the arm at each of these locations and signals to the controller.

DETAILED DESCRIPTION

The present invention is directed to an arm, generally illustrated as 20, which directs media sheets through different paths within an image forming device 100. The arm 20 is mounted to pivot when contacted by the media sheet, or when an access door 380 is opened or closed. A sensor 70 positioned adjacent to the arm 20 senses movement of the arm 20 to determine the location and timing of the media sheets, and/or the position of the access door 380.

Figure 1:
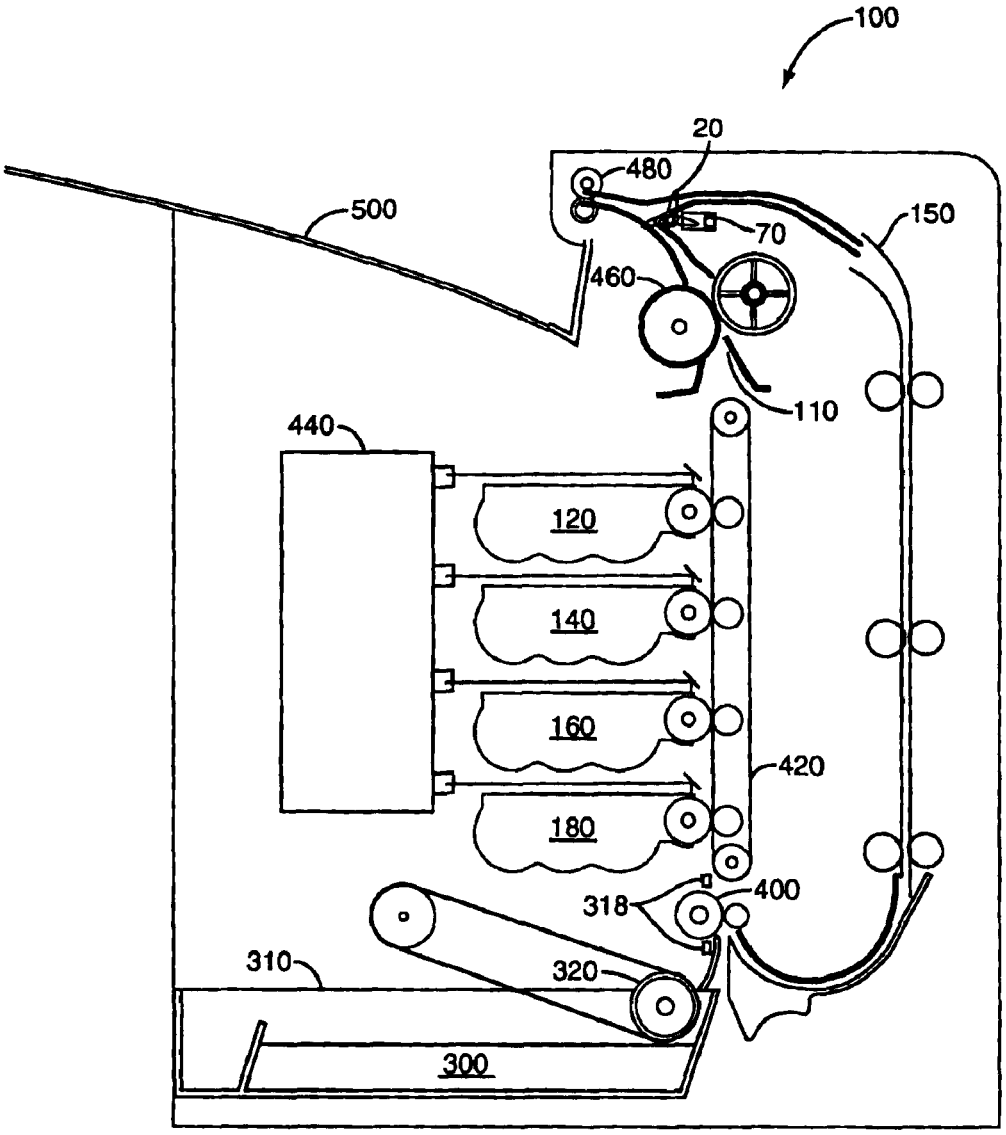
FIG. 1 is a schematic view of an image forming device constructed according to one embodiment of the present invention.

FIG. 1 depicts an image forming device, indicated generally by 100. The operation of the image forming device 100 is conventionally known. A single media sheet is "picked," or selected, from a primary media stack 300 in a removable tray 310 by pick roller 320. The media sheet is presented at registration rollers 400, which align the sheet and precisely controls its further movement along the first paper path 110. The media sheet passes the registration roller 400 and electrostatically adheres to transport belt 420, which carries the media sheet successively past the four toner cartridges 180, 160, 140, and 120. At each toner cartridge 180, 160, 140, 120, a latent image is formed by printhead 440 onto the respective photoconductive (PC) drum in each toner cartridge. Toner is applied to the PC drum, which is subsequently deposited on the media sheet as it is conveyed past the toner cartridges 180, 160, 140, 120 by the transport belt 420. The toner is thermally fused to the media sheet by the fuser 460. The media sheet is then moved through the arm 20 which directs the sheet to output rolls 480. The media sheet is then either output from the device 100 into output tray 500, or reversed and sent through a second, duplex path 150 for forming a toner image on a second side of the sheet.

Figure 2:
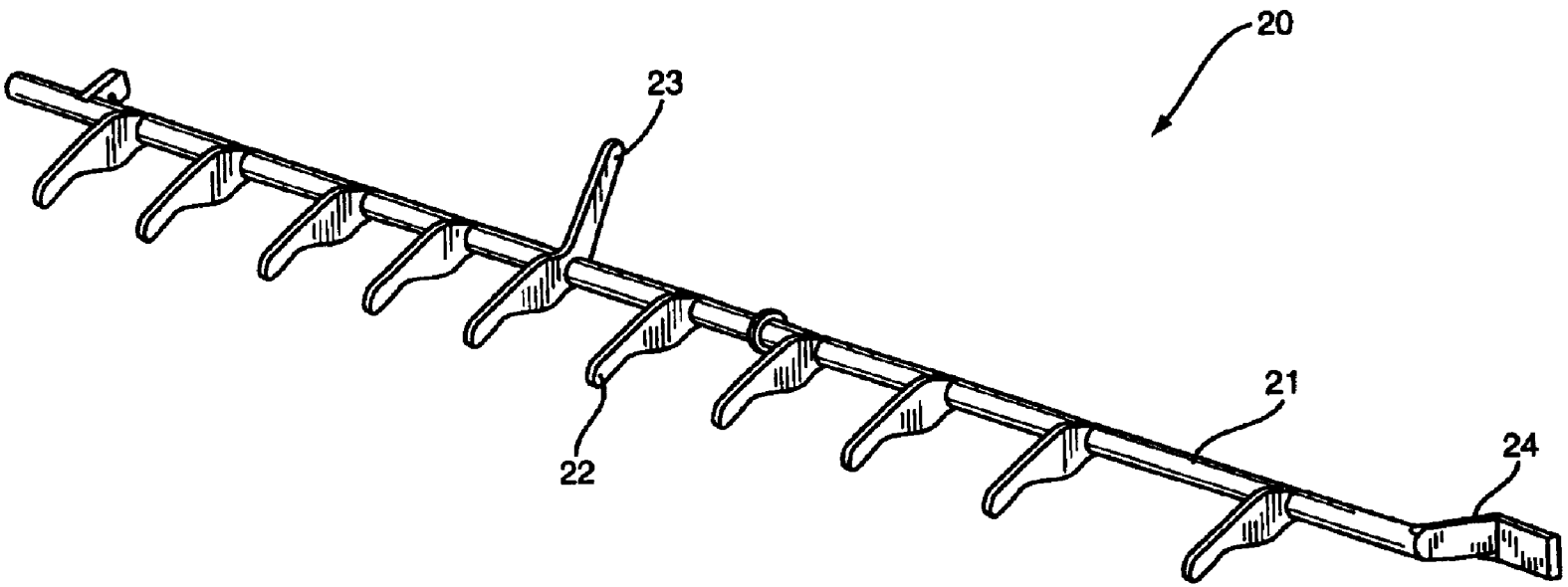
FIG. 2 is a perspective view of an arm constructed according to one embodiment of the present invention.

FIG. 2 illustrates the arm 20 that directs the media sheets along the first path 110 and second path 150. Arm 20 includes a rod 21 having outwardly extending first member 22, second member 23, and third member 24. Arm 20 is pivotally connected to the image forming device 100 such that the members 22, 23, 24 move between positions depending upon the position of a media sheet moving along the first and second paths 110, 150, and the orientation of the access door 380. Arm 20 may have a variety of lengths to extend across a portion or the entirety of the paper paths 110, 150. In the embodiment of FIG. 2, arm 20 includes a plurality of first members 22 extending outward along the length, a single second member 23, and a single third member 24. The present invention contemplates various numbers of first, second, and third members 22, 23, 24 extending outward from the rod 21.

Figure 3:
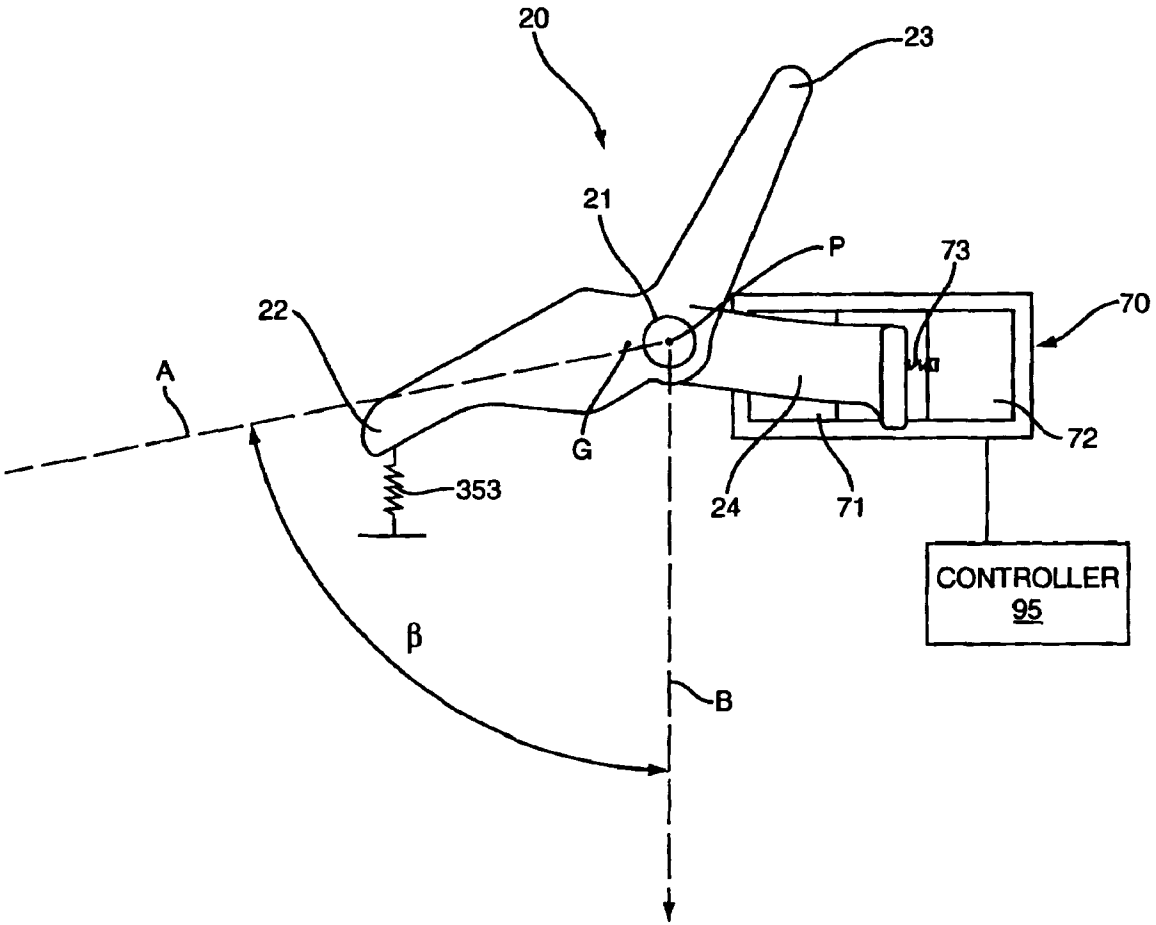
FIG. 3 is a cross-sectional view of the arm with a sensor positioned adjacent to the arm and operatively connected to a controller.

FIG. 3 illustrates a cross-sectional view of the arm 20. Arm 20 pivots about a point P that is positioned in the center of the rod 21. In one embodiment illustrated in FIG. 4, arm 20 defaults to the first position when there are no other forces acting upon it, such as media sheet contact or the access door 380 being opened. In one embodiment, a biasing mechanism 353 extends between the arm 20 and image forming device 100 to bias the arm 20 towards the first position. In another embodiment, arm 20 defaults at the first position because a center of gravity G of the arm 20 is positioned along the first member 22 outward from point P. The position of the center of gravity G causes the arm 20 to rotate about point P such that the first member 22 blocks the first path 110. In one embodiment, as illustrated in FIG. 3, a line A drawn through the pivot P and center of gravity G forms an angle $\beta$ of about 79° with a line B defining the gravitational force. In both embodiments, the external forces that act upon the arm 20 are adequate to overcome the default forces and pivot the arm 20 from the first position.

A sensor 70 is positioned relative to the third member 24 to detect the movement of the arm 20.

Various types of sensors 30 may be used to detect movement of the arm 20. In one embodiment, a transmission sensor is used for detecting the characteristics. A transmission sensor transfers a signal from one location to another by means of light, radio, or infrared beams, or other like communication signals. In one embodiment, sensor 70 includes a transmitter 71 that transmits a light beam 73 that is received by receiver 72. One type of light beam sensor is Model No. OJ6202XXX manufactured by Aleph International. Another embodiment features a proximity sensor that produces a signal when approached by an object. Sensors may use a variety of techniques to determine the characteristics including transmission sensing, reflectance sensing, capacitance sensing, inductance sensing, and magnetically-based sensing.

Figure 4:
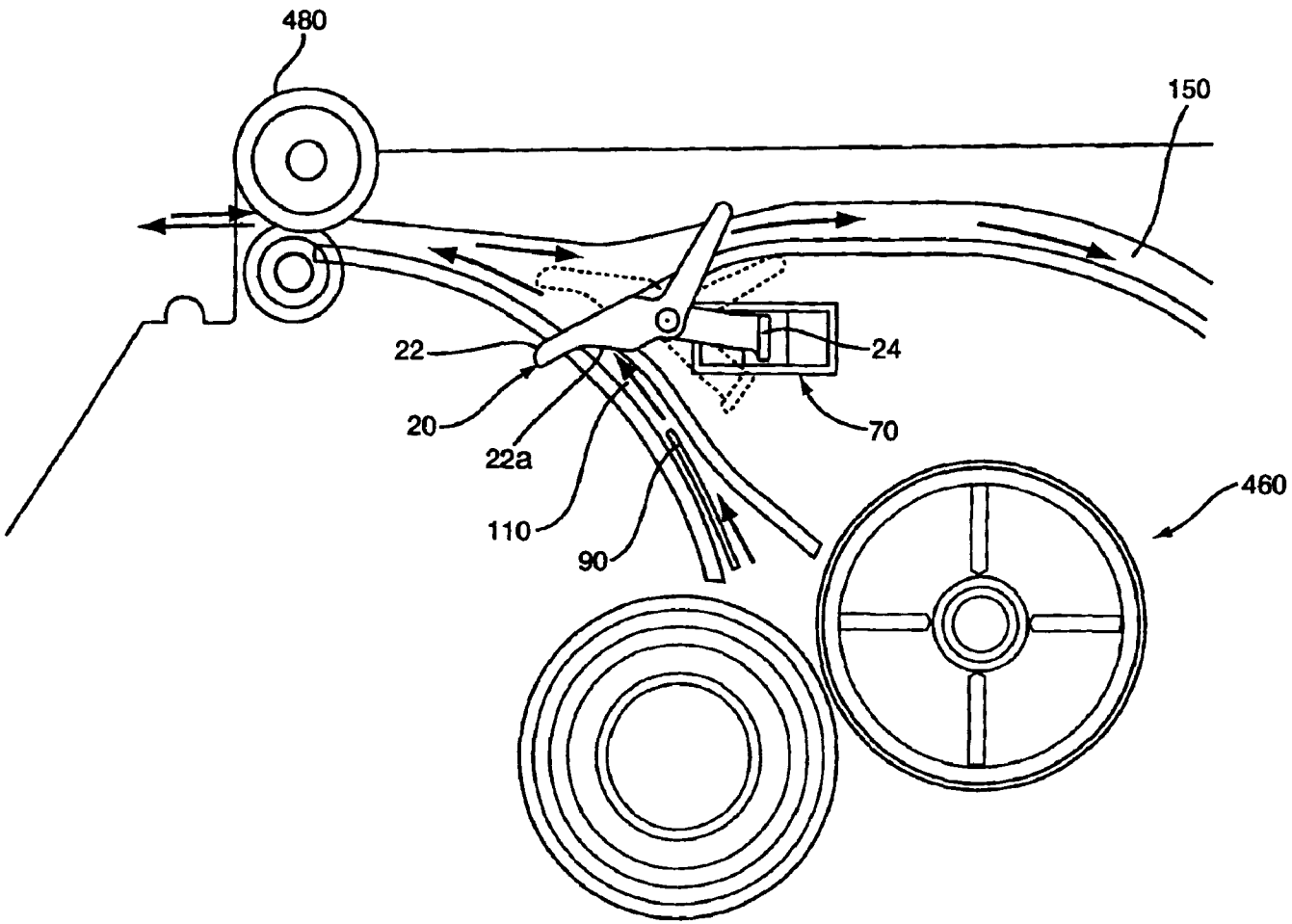
FIG. 4 is a partial side view of the arm positioned in a first orientation across a paper path leading from the fuser according to one embodiment of the present invention, and a dashed-line image of the arm in a second position.

FIG. 4 illustrates the arm 20 positioned at an intersection of the first path 110 and the second path 150 and downstream from the fuser 460. The orientation of the arm 20 illustrated in solid lines indicates the first, default position. The arm position in dashed lines indicates the second position that is discussed in detail below.

As illustrated in FIG. 4, arm 20 assumes the first position when no forces are acting upon it with across the first path 110. In FIG. 4, the arm 20 is in the first position as the leading edge of a media sheet 90 is exiting the fuser 460. In the first orientation, the position of the third member 24 is detected by the sensor 70. The controller 95 interprets the signal as indicating that the leading edge of the media sheet 90 has not yet reached the arm 20.

Figure 5:
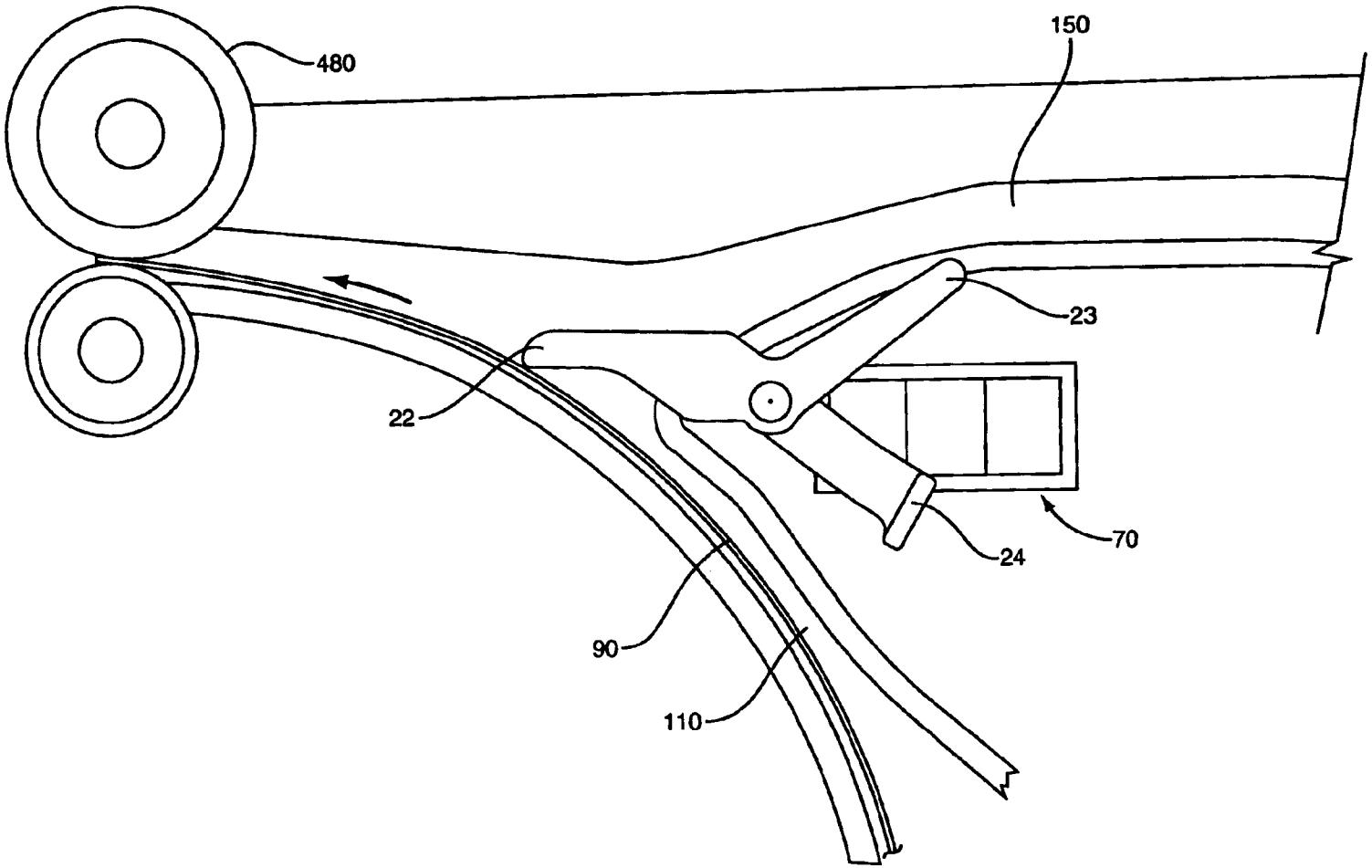
FIG. 5 is a partial side view of the arm positioned in a second orientation with a media sheet moving along the paper path according to one embodiment of the present invention.

FIG. 5 illustrates the media sheet 90 contacting the arm 20. The force of the media sheet 90 being driven by the fuser rolls 460 and/or output rolls 480 causes the arm 20 to pivot to the second position from the first position such that first member 22 does not block the first path 110. The third member 24 moves away from the sensor 70 when the arm 20 is in the second position. The sensor 70 detects the movement and signals the controller 95. Controller 95 interprets the signal as indicating the media sheet is currently passing the arm 20. Arm 20 remains in the second position until the trailing edge of the media sheet 90 passes. Arm 20 then pivots to the first position due to the biasing mechanism or arm weighting. Upon passing the arm 20, media sheet 90 is either driven by the output rolls 480 and exited from the image forming device 100 into the output tray 500, or duplexed through the second path 150.

Figure 6:
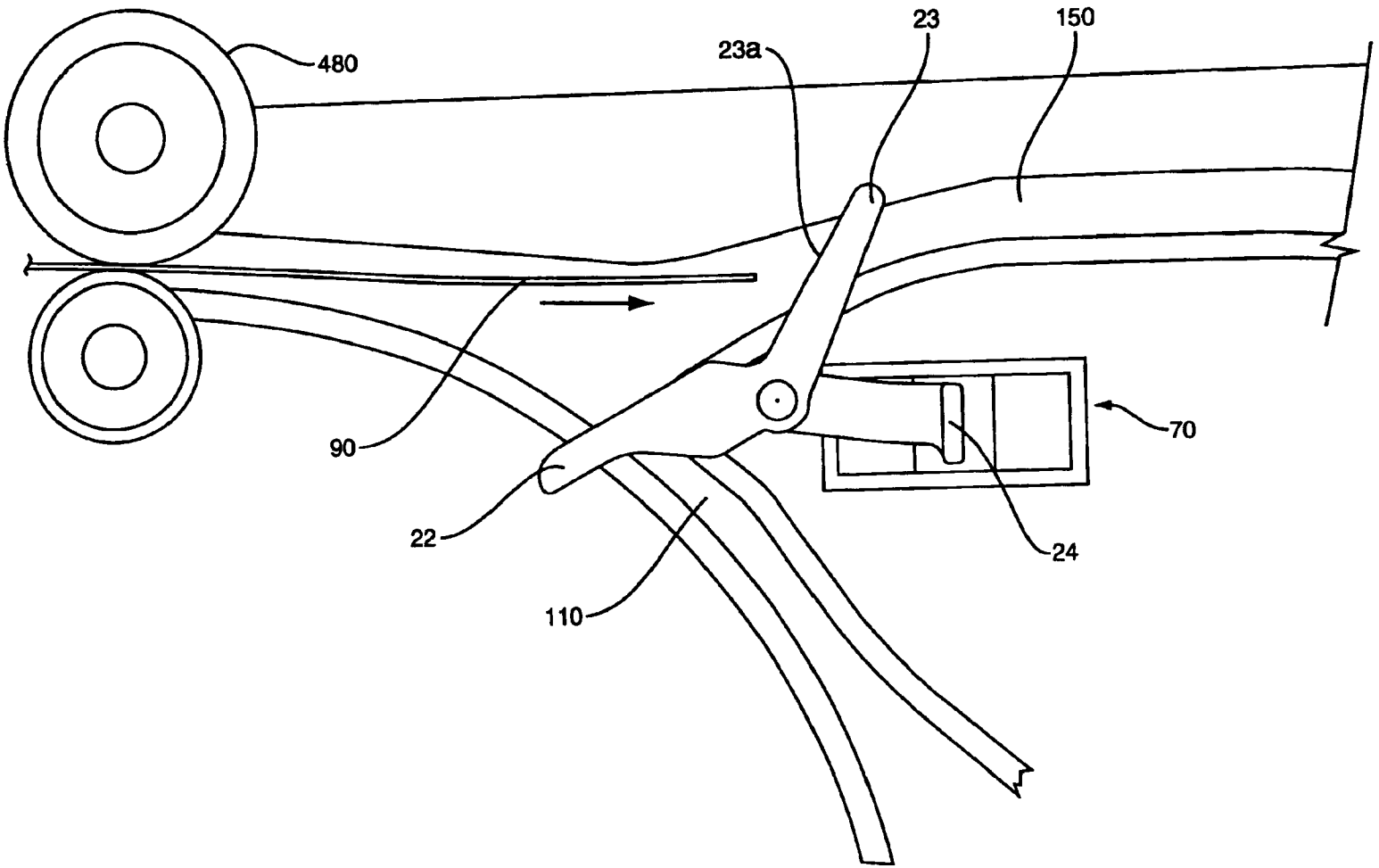
FIG. 6 is a partial side view of the arm returned to the first position after the media sheet has passed the arm and prior to contact with a second member according to one embodiment of the present invention.

FIG. 6 illustrates the media sheet 90 at a time when the trailing edge has moved beyond the arm 20. Arm 20 has returned to the first position after the trailing edge of the media sheet 90 passes the first member 22. The movement of the arm 20 back to the first position is detected by the sensor 70 which signals the controller 95.

The output rolls 480 reverse direction and feed the media sheet 90 into the second path 150. The arm 20 is positioned with the first member 22 extending across the first path 110 blocking the media sheet 90 from being inadvertently driven back into the first path 110. The media sheet 90 is blocked from re-entry by the plurality of first members 22 that extend along the length of the arm 20.

Figure 7:
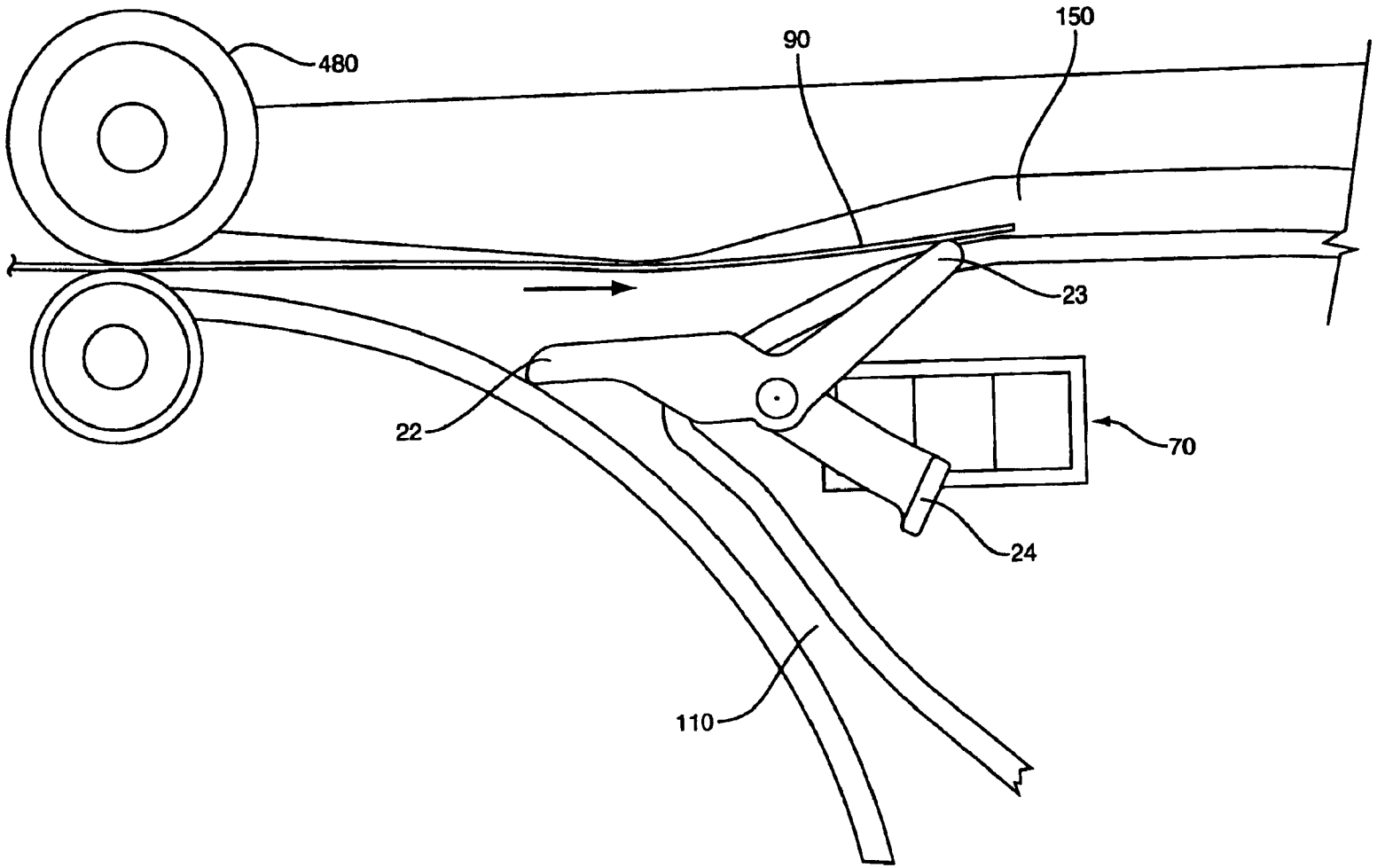
FIG. 7 is a partial side view of the arm pivoted with the second member out of the second path as a media sheet moves along the second paper path according to one embodiment of the present invention.

FIG. 7 illustrates the media sheet 90 contacting the second member 23. The force of the driven media sheet 90 pivots the arm 20 to allow entry into the second path 150. The sensor 70 is again tripped as the third member 24 pivots away from the sensor 70 thus registering a signal which is interpreted by the controller 95 as the media sheet 90 entering the second path 150. Once the trailing edge of the media passes the second member 23, arm 20 pivots back to the first position as illustrated in FIG. 4. The movement of the arm 20 back to the first position is sensed by the sensor 70 and signals the controller 95 indicating that the media sheet 90 has entered the second path 150 and the trailing edge has passed the arm 20.

Figure 8:
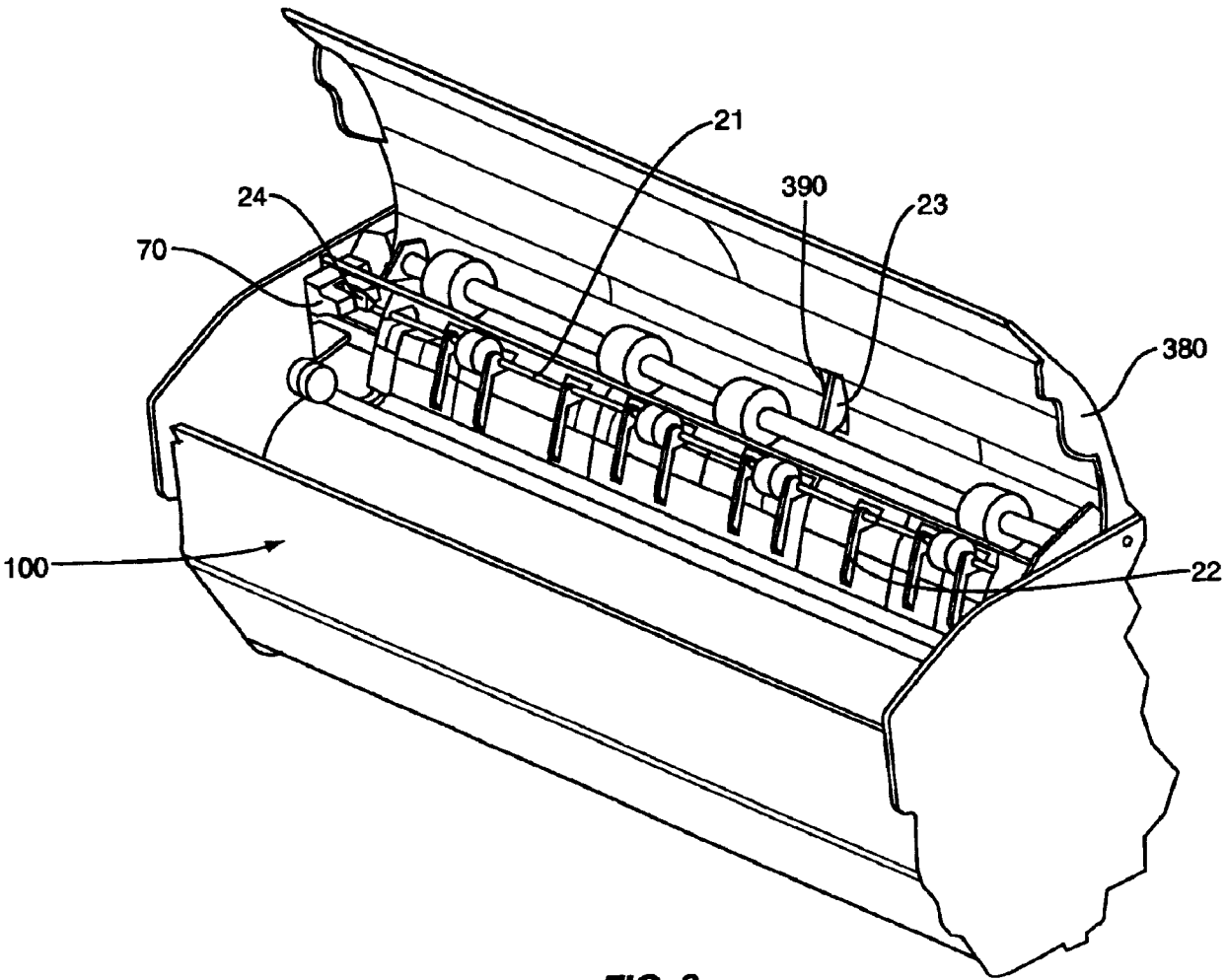
FIG. 8 is a partial perspective view of an access door in an open orientation according to one embodiment of the present invention.
Figure 9:
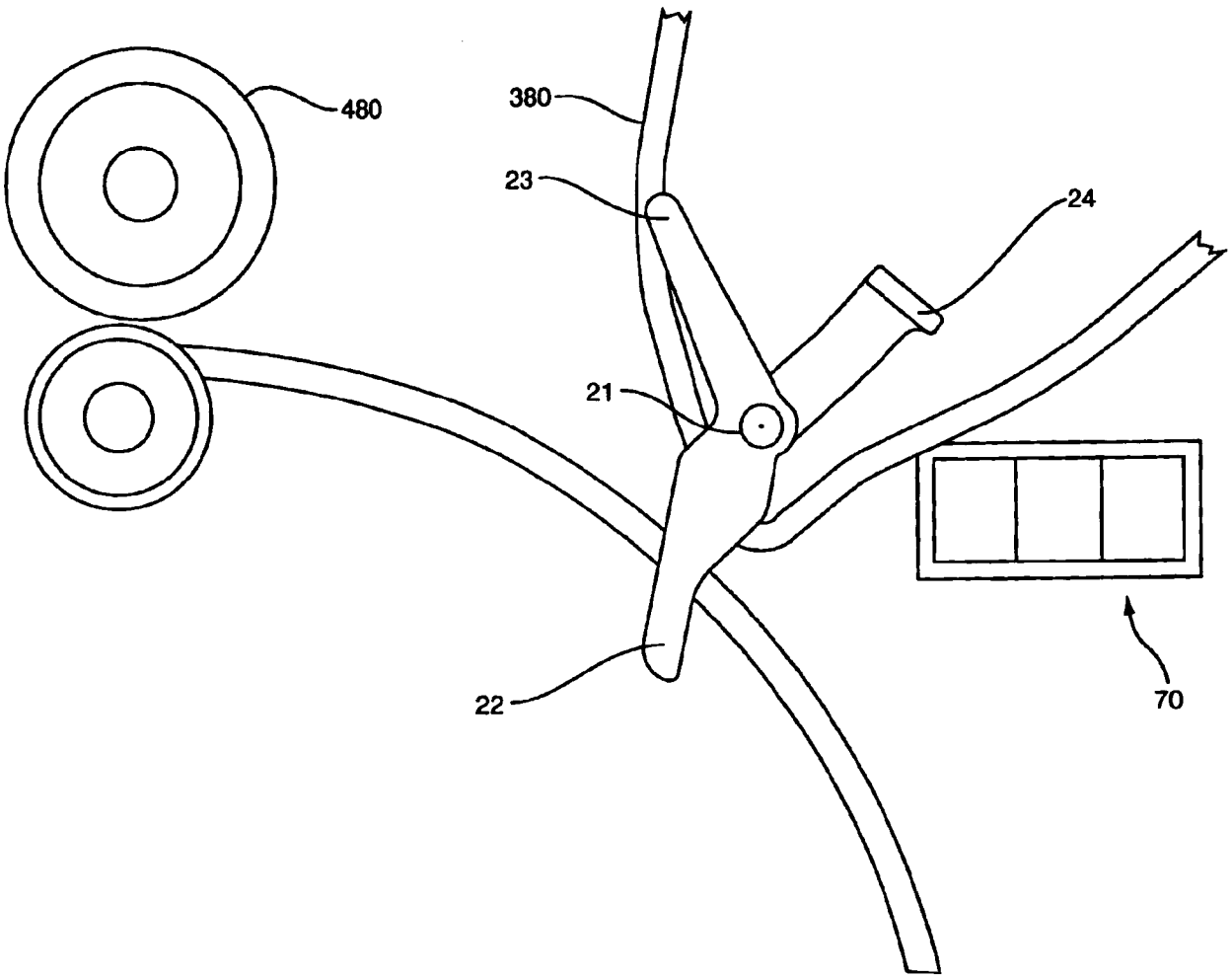
FIG. 9 is a partial side view of the access door in the open orientation and the arm pivoted according to one embodiment of the present invention.

In one embodiment, the arm 20 is positioned to sense the orientation of an access door 380. Access door 380 is positioned on the image forming device 100 to access the fuser 460. The access door 380 is pivotally connected to the image forming device 100 and positionable between open and closed orientations. In the open orientation, the access door 380 is pivoted to access the fuser 460, and at least a portion of the first path 110. FIG. 8 illustrates the access door 380 in an open orientation. FIG. 9 illustrates a partial side view illustrating the arm 20 in a third position when the access door 380 in an open orientation. Arm 20 pivots with the opening of the access door 380 and the third member 24 moves from the sensor 70. This movement is detected and signaled to the controller 95 indicating the opening of the access door 380. The arm 20 pivots back towards the first position upon closing the access door 380. In one embodiment, access door 380 includes an opening 390 through which the second member 23 extends.

Figure 10:
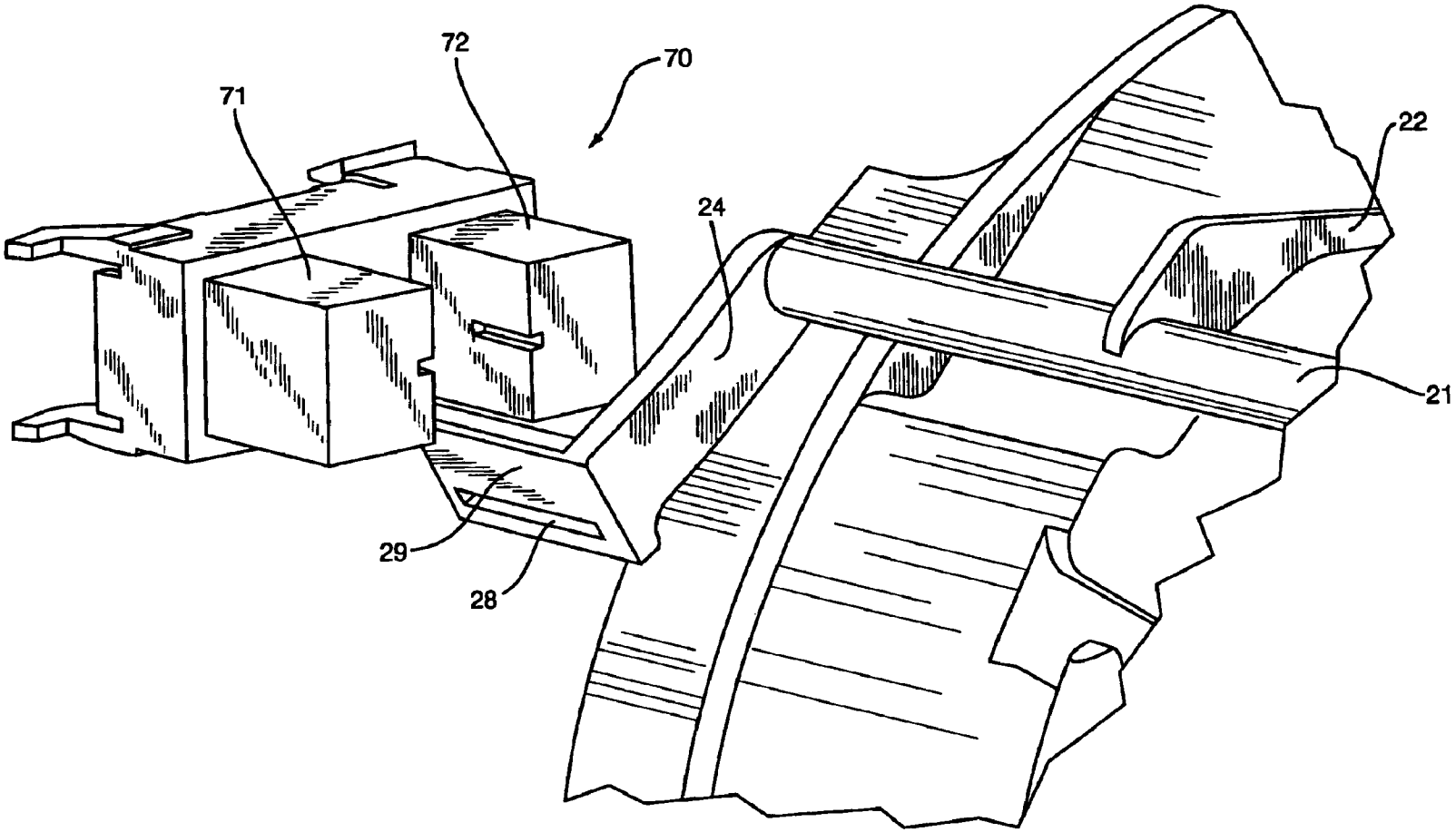
FIG. 10 is a partial perspective view of the sensor positioned adjacent to the arm according to one embodiment of the present invention.
Figure 11:
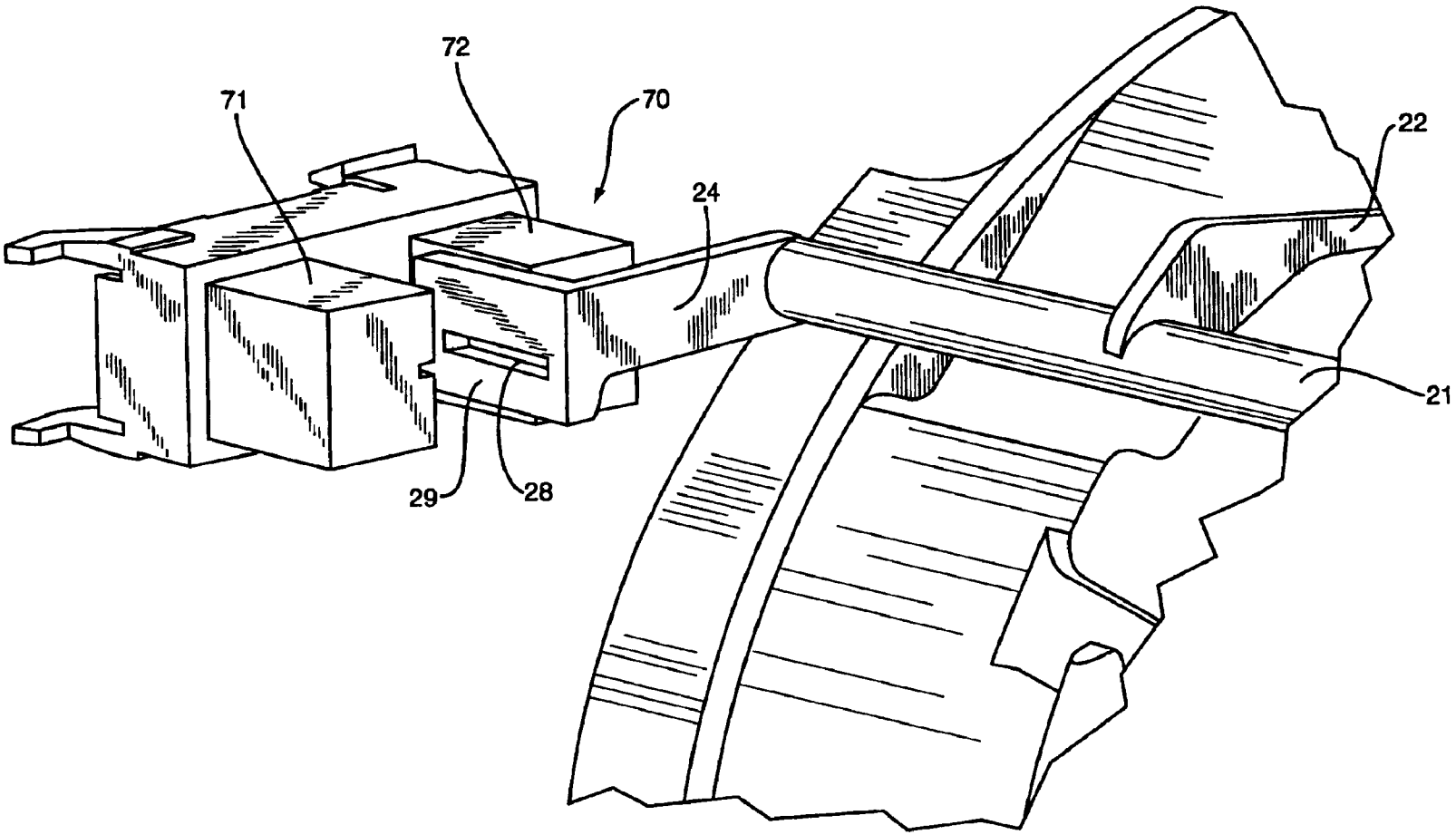
FIG. 11 is a partial perspective view of the third member positioned between the sensor according to one embodiment of the present invention.

FIGS. 10 and 11 illustrate one embodiment of a sensor 70 and the third member 24. The sensor 70 features a transmitter 71 that emits a light beam that is received by receiver 72. The third member 24 includes a paddle 29 having an opening 28. The opening 28 is sized for the light beam to pass from the transmitter 71 to the receiver 72, while the remainder of the paddle 29 blocks the passage of the light beam. In one embodiment, opening 28 is offset from a reference line of the paddle 29. The sensor 70 and third member 24 may be arranged in a number of different manners. The sensor 70 may be blocked by the paddle 29, or may not be blocked when the arm 20 is in the first position. Likewise, pivoting of the arm 20 may cause blocking or unblocking of the sensor 70 depending upon the specific arrangement. One embodiment of an arm having different characteristics in different sections of the arm is disclosed in U.S. patent application Ser. No. 10/639,297 entitled "Image Forming Device Having a Sensor with Two Separate Distinguishable Triggers" filed on the same day as the present application, assigned to Lexmark International, Inc., and incorporated herein by reference in its entirety.

There are a number of different manners of positioning the arm 20 to be detected by the sensor 70. The controller 95 can be established to receive and interpret the signals to determine the movement of the media sheets 90 through the first and second path 110, 150, and the position of the access door 380.

The opening 28 may further be used to determine movement of the arm 20 to the third position. In one embodiment, paddle 29 breaks the light beam with the arm 20 in the first position. When moving from the first position to the third position, arm 20 pivots such that the opening 28 moves between the sensor 70. Therefore, the light beam is initially broken as the arm 20 is in the first position, not broken as the opening 28 passes through the sensor, broken when the remainder of the paddle passes through the sensor 70, and again not broken after the paddle moves from the sensor 70 in the third position (see FIG. 9). Controller 95 receives this string of signals from the sensor 70 and interprets it as the access door 380 being opened with the arm 20 moving from the first position to the third position.

In one embodiment, controller 95 includes a microprocessor, random access memory, read only memory, and in input/output interface. Controller 95 is operatively connected to media sensing and moving devices including the pick roll 320, drive motors that drive the transfer belt 420, one or more media sensor(s) 318 positioned along one or both paper paths 110, 150, fuser rolls 460, and one or more nip rolls along the paths 110, 150. In one embodiment, at some designated time, controller 95 signals the pick rolls 320 to pick a media sheet 90. The media sheet 90 moves through the beginning of the first path 110 and eventually trips a paper path sensor 318. Controller 95 immediately begins tracking incrementally the position of the media sheet 90 by monitoring the feedback of media sensing and moving devices. Controller 95 can further determine the length of the media sheet 90 as it moves past the media sensors 318. Embodiments of a similar system are disclosed in U.S. Pat. No. 6,330,424, and U.S. patent application Ser. No. 10/436,406 entitled "Pick Mechanism and Algorithm for an Image Forming Apparatus" filed May 12, 2003, both of which are assigned to Lexmark International, Inc., and herein incorporated by reference in their entirety.

Controller 95 is able to receive signals from the sensor 70 to track the position of the media sheet 90, and determine and locate a position of a paper jam. The controller 95 tracks the position of the media sheet along the first path 110. The controller 95 determines a paper jam if no signal is received from the sensor 70 within an expected time that the arm 20 has moved from the first position to the second position within an expected time. Likewise, controller 95 determines if the media sheet 90 clears the first path 110 by monitoring the arm 20 movement from the second position to the first position. Likewise, controller 95 monitors movement of the media sheet 90 into the second path 150 by monitoring the movement of the arm 20.

Controller 95 further receives signals from the sensor 70 indicating the arm 20 has moved to the third position to indicate opening of the access door 380. The controller 95 can determine the position of the media sheet 90 at the opening of the access door 380.

The term "image forming device" and the like is used generally herein as a device to produce images on a media sheet 90. Examples include but are not limited to a laser printer, ink-jet printer, fax machine, copier, and a multi-functional machine. One example of an image forming device is Model No. C750 available from Lexmark International, Inc. of Lexington, Ky.

The embodiment described includes a direct transfer from a series of photoconductive drums to the media sheet 90. The present invention is also applicable for image forming devices 100 having secondary transfer of the toner image from an intermediate member to the media sheet. Further, the image forming device 100 may use any number of cartridges.

In the embodiments described above, sensor 70 is positioned to detect movement of the arm 20 by monitoring the movement of the third member 24. The movement of the first member 22, second member 23, or rod 21 may also be sensed to determine the movement and position of the arm 20. Additionally, more than one sensor 70 may be used for detecting movement and position of the arm 20.

The orientation of the arm 20 and shape of the first member 22 may be such to facilitate movement of the media sheets 90. In one embodiment, the arm 20 is orientated in the first position to form an obtuse angle between the first paper path 110 and the bottom surface 22*a* of the first member that is contacted by the media sheet after leaving the fuser rolls 460. The angle becomes larger as the arm 20 is pivoted to the second position to facilitate movement of the media sheet 90. Likewise, as illustrated in FIG. 6, an angle formed between the media sheet and top surface of the second member 23 forms an obtuse angle to facilitate movement of the media sheet along the second path 150. The arm 20 may also have other orientations depending upon the specific parameters.

In one embodiment, the position of the arm 20 at the first position is controlled by the first member 22 contacting an abutment (not illustrated) extending outward from the image forming device 100. In another embodiment, the position is controlled because the second member 23 contacts the access door 380 thus limiting the extent of arm pivot.

The present invention may be carried out in other specific ways than those herein set forth without departing from the scope and essential characteristics of the invention. In one embodiment, the arm 20 is not directly contacted by the media sheet 90 when being pivoted. The arm 20 is pivoted by other means based on the position of the media sheet 90 along the first and second media paths 110, 150. In one embodiment, arm 20 is positioned to detect the movement of an internal part of the image forming device. The example of the access door 380 is just one type of part that may be sensed. The present embodiments are, therefore, to be considered in all respects as illustrative and not restrictive, and all changes coming within the meaning and equivalency range of the appended claims are intended to be embraced therein.

What is claimed is:

1. A device to sense operating conditions within an image forming apparatus comprising:

an element operatively connected to the image forming apparatus and positionable between a first orientation and a second orientation;

a first media path and a second media path; and a sensor assembly comprising a rod with radially spaced first, second, and third arms;

the rod being movable between a first position where the first arm blocks the first path, a second position where the first arm does not block the first path, and a third position associated with the element being in the second orientation;

the rod assumes the third position when the element is moved from the first orientation to the second orientation.

2. The apparatus of claim 1, wherein the rod is positioned at an intersection of the first media path and the second media path with the first arm being positionable to extend into the first media path, and the second arm being positionable to extend into the second media path.

3. The apparatus of claim 2, wherein the sensor comprises a detector that detects movement of the third arm.

4. The apparatus of claim 1, wherein the rod pivots about a point that is located adjacent to the first media path and the second media path, a center of gravity of the rod being positioned along the first arm at a distance from the point.

5. The apparatus of claim 1, further comprising a biasing mechanism attached to the rod to bias the arm towards the first position.

6. The apparatus of claim 1, wherein the element is an access door movable between an open position and a closed position.

7. The apparatus of claim 1, wherein the third arm comprises a paddle having a slot.

8. A device to sense operating conditions within an image forming apparatus comprising:

a first media path;

a second media path that intersects with the first media path;

an arm positioned adjacent to an intersection of the first media path and the second media path, the arm having a rod, a first member extending outward from the rod in a first direction to contact media moving along the first media path, a second member extending outward from the rod in a second direction to contact the media moving along the second media path, and a third member extending outward from the rod in a third direction away from the first member and the second member;

an element operatively connected to the image forming apparatus and positionable between a first orientation and a second orientation;

a sensor positioned adjacent to the third member to sense the movement of the arm between a first position with the media moving along the first media path, a second position with the media moving along the second media path, and a third position when the element moves from the first orientation to the second orientation.

9. The apparatus of claim 8, wherein the element contacts the arm in the second orientation.

10. The apparatus of claim 8, wherein the third member is axially positioned at an end of the rod.

11. The apparatus of claim 8, wherein the sensor includes a transmitter and a receiver that are spaced apart, and the third member comprises a paddle that moves between the transmitter and receiver as the arm pivots.

12. The apparatus of claim 11, wherein the third member comprises an opening within the paddle.

13. The apparatus of claim 12, wherein the opening is offset from a center of the paddle.

14. The apparatus of claim 8, further comprising a biasing means for biasing the first member towards extending across the first media path.

15. A method of sensing operating conditions of an image forming apparatus comprising the steps of:

positioning a rod towards a first position wherein the rod blocks a first path;

moving the rod to a second non-blocking position in response to a media sheet moving in a first direction along the first path; and moving the rod to a third position by opening an access door.

16. The method of claim 15, further comprising returning the rod to the first position from the second position after the media sheet moves along the first path beyond the rod.

17. The method of claim 16, further comprising reversing the direction of the media sheet and directing the media sheet into a second path by positioning the rod in the first position and preventing the media sheet from moving into the first path.

18. The method of claim 15, further comprising sensing the rod moving from the first position to the second non-blocking position and signaling a controller.

19. The method of claim 15, wherein the step of moving the rod to the second non-blocking position in response to the media sheet moving in the first direction along the first path comprises driving the media sheet in the first direction with a pair of rollers and overcoming a closing force on the arm and moving the arm to the second non-blocking position.

20. A method of directing a media sheet through an image forming apparatus comprising the steps of:

positioning an arm in a first position with a first section extending across a first media path;

moving the media sheet along the first media path to contact the first section;

pivoting the arm from the first position to a second position with the first section out of the first media path and moving the media sheet along the first media path past the arm;

after a trailing edge of the media sheet passes the arm, pivoting the arm back to the first position;

reversing the direction of the media sheet and preventing the media sheet from re-entering the first media path and directing the media sheet towards a second media path;

moving the media sheet along the second media path to contact a second section of the arm extending across the second media path;

pivoting the arm from the first position to the second position with the second section out of the second media path and moving the media sheet along the second media path past the arm; and after the trailing edge of the media sheet passes the arm, pivoting the arm back to the first position.

21. A method of sensing operating conditions within an image forming apparatus, comprising the steps of:

sensing an arm in a first position extending across a first path;

sensing the arm moving to a second position as a media sheet moves past the arm in the first path;

sensing the arm move to a third position when an element operatively connected to the image forming apparatus is moved from a first orientation to a second orientation.

22. The method of claim 21, further comprising sensing the arm moving from the second position to the first position after the media sheet passes the arm.

23. The method of claim 21, further comprising sensing the arm moving as the media sheet moves past the arm in a second path.

24. The method of claim 21, further comprising determining the timing for the arm to move past a sensor to determine the position of the media sheet.

* * * * *